US012292043B2

(12) United States Patent
Wang

(10) Patent No.: US 12,292,043 B2
(45) Date of Patent: May 6, 2025

(54) CORE OF DUAL-MOTOR DRIVEN INFLATABLE PUMP

(71) Applicant: Wei-Chi Wang, Tainan (TW)

(72) Inventor: Wei-Chi Wang, Tainan (TW)

( * ) Notice: Subject to any disclaimer, the term of this patent is extended or adjusted under 35 U.S.C. 154(b) by 139 days.

(21) Appl. No.: 18/326,644

(22) Filed: May 31, 2023

(65) Prior Publication Data

US 2024/0401579 A1 Dec. 5, 2024

(51) Int. Cl.

| | |
|---|---|
| ***F04B 35/04*** | (2006.01) |
| ***F04B 9/02*** | (2006.01) |
| ***F04B 17/03*** | (2006.01) |
| ***F04B 19/22*** | (2006.01) |
| ***F04B 35/01*** | (2006.01) |
| ***F04B 39/00*** | (2006.01) |
| ***F04B 39/06*** | (2006.01) |
| ***F04B 39/12*** | (2006.01) |
| ***F04D 19/00*** | (2006.01) |
| ***F04D 25/06*** | (2006.01) |

(52) U.S. Cl.

CPC ..... *F04B 35/04* (2013.01); *F04B 9/02* (2013.01); *F04B 17/03* (2013.01); *F04B 19/22* (2013.01); *F04B 35/01* (2013.01); *F04B 39/0094* (2013.01); *F04B 39/066* (2013.01); *F04B 39/12* (2013.01); *F04B 39/121* (2013.01); *F04B 39/122* (2013.01); *F04B 39/123* (2013.01); *F04D 19/002* (2013.01); *F04D 25/06* (2013.01)

(58) Field of Classification Search

CPC ..... F04B 35/04; F04B 35/01; F04B 39/121; F04B 17/03; F04B 39/066; F04B 39/122; F04B 39/123; F04B 9/02; F04B 39/0094; F04B 19/22

See application file for complete search history.

(56) References Cited

U.S. PATENT DOCUMENTS

2004/0219040 A1* 11/2004 Kugelev ..... F04B 17/03 417/415

2015/0078924 A1* 3/2015 Zhang ..... E21B 43/00 417/228

* cited by examiner

*Primary Examiner* — Peter J Bertheaud

(74) *Attorney, Agent, or Firm* — FISHERBROYLES, LLP; Roger L. Browdy; Ronni S. Jillions

(57) ABSTRACT

A core of a dual-motor-driven inflatable pump has a base, a cylinder, two electric motors, and a drive wheel set. The base has an assembly portion, a fixing portion, and a receiving space formed between the assembly portion and the fixing portion. The cylinder is disposed on the base and has a cylinder body, a cylinder head, and a piston rod. The cylinder body is disposed on the fixing portion via the cylinder head. The piston rod is disposed in the cylinder body and extends in the receiving space via the fixing portion. The two electric motors are disposed on the assembly portion of the base, and each has a drive shaft extended in the receiving space. The drive wheel set is disposed in the receiving space of the base and has a driven gear and two drive gears engaging with the driven gear.

6 Claims, 5 Drawing Sheets

CORE OF DUAL-MOTOR DRIVEN INFLATABLE PUMP

BACKGROUND OF THE INVENTION

1. Field of the Invention

The present invention relates to an electric inflatable pump, and more particularly to a core of a dual-motor-driven inflatable pump that can meet the needs of high output power and high inflation speed.

2. Description of Related Art

A conventional inflatable pump is used to inflate objects such as tires of motor vehicles. There are two types of the conventional inflatable pump: manual and electric. A conventional electric inflatable pump is labor-saving and has good inflation efficiency, and is chosen by most motor vehicle drivers.

The conventional electric inflatable pump has a base and a core disposed on the base. The core has a cylinder driven by a single electric motor. Based on cost considerations, electric motors of model numbers RS380, 390, 540 or 550 are generally used. The aforementioned electric motors of model numbers RS380, 390, 540 or 550 are automatic volume products and have low cost.

A core of the conventional electric inflatable pump uses a single electric motor to operate, based on portability and storage, and most of the motor vehicles are general type RVs, etc., the output powers of electric motors of model numbers RS380, 390, 540 or 550 are relatively small, which can meet the needs of use.

With the improvement of people's living standards and economic capabilities, some people like to drive off-road vehicles for outdoor driving activities. However, for four-wheel drive off-road motor vehicles, it is often necessary to adjust the pressure of the tires in response to different environments and road conditions. Therefore, it is often necessary to inflate the tires by an electric inflatable pump. Generally, compared with the tires of common motor vehicles, the tires of the off-road motor vehicles are generally larger in volume, and the requirements for tire inflation pressure are also relatively high. For inflatable objects with large volume and high air pressure requirements, the core of the conventional electric inflatable pump is limited by the output power of the single electric motor, and it is difficult to meet the special inflation requirements. Some people may consider using an electric motor with a larger output power to meet the needs of high output power and high inflation speed. However, the electric motor that meets the requirements of high output power and high inflation speed is not a common electric motor in the industry. The cost of using an electric motor with high output power is several times higher than the cost of using a common electric motor. It is not conducive to the product competitiveness of electric inflatable pumps that meet special inflation needs. Therefore, how to balance performance and economy is an important issue for the development of electric inflatable pumps.

To overcome the shortcomings, the present invention tends to provide a core of a dual-motor-driven inflatable pump, to mitigate or obviate the aforementioned problems.

SUMMARY OF THE INVENTION

The main objective of the present invention is to provide a core of a dual-motor-driven inflatable pump that can meet the needs of high output power and high inflation speed.

The core of a dual-motor-driven inflatable pump in accordance with the present invention has a base, a cylinder, two electric motors, and a drive wheel set. The base has an assembly portion, a fixing portion, and a receiving space formed between the assembly portion and the fixing portion. The cylinder is disposed on the base and has a cylinder body, a cylinder head, and a piston rod. The cylinder body is disposed on the fixing portion via the cylinder head. The piston rod is disposed in the cylinder body and extends in the receiving space via the fixing portion. The two electric motors are disposed on the assembly portion of the base, and each has a drive shaft extended in the receiving space. The drive wheel set is disposed in the receiving space of the base and has a driven gear and two drive gears engaging with the driven gear. The two electric motors drive the two drive gears to rotate in a same direction to drive the piston rod to move reciprocatingly via the driven gear.

Other objects, advantages and novel features of the invention will become more apparent from the following detailed description when taken in conjunction with the accompanying drawings.

DETAILED DESCRIPTION OF THE PREFERRED EMBODIMENT

Figure 1:
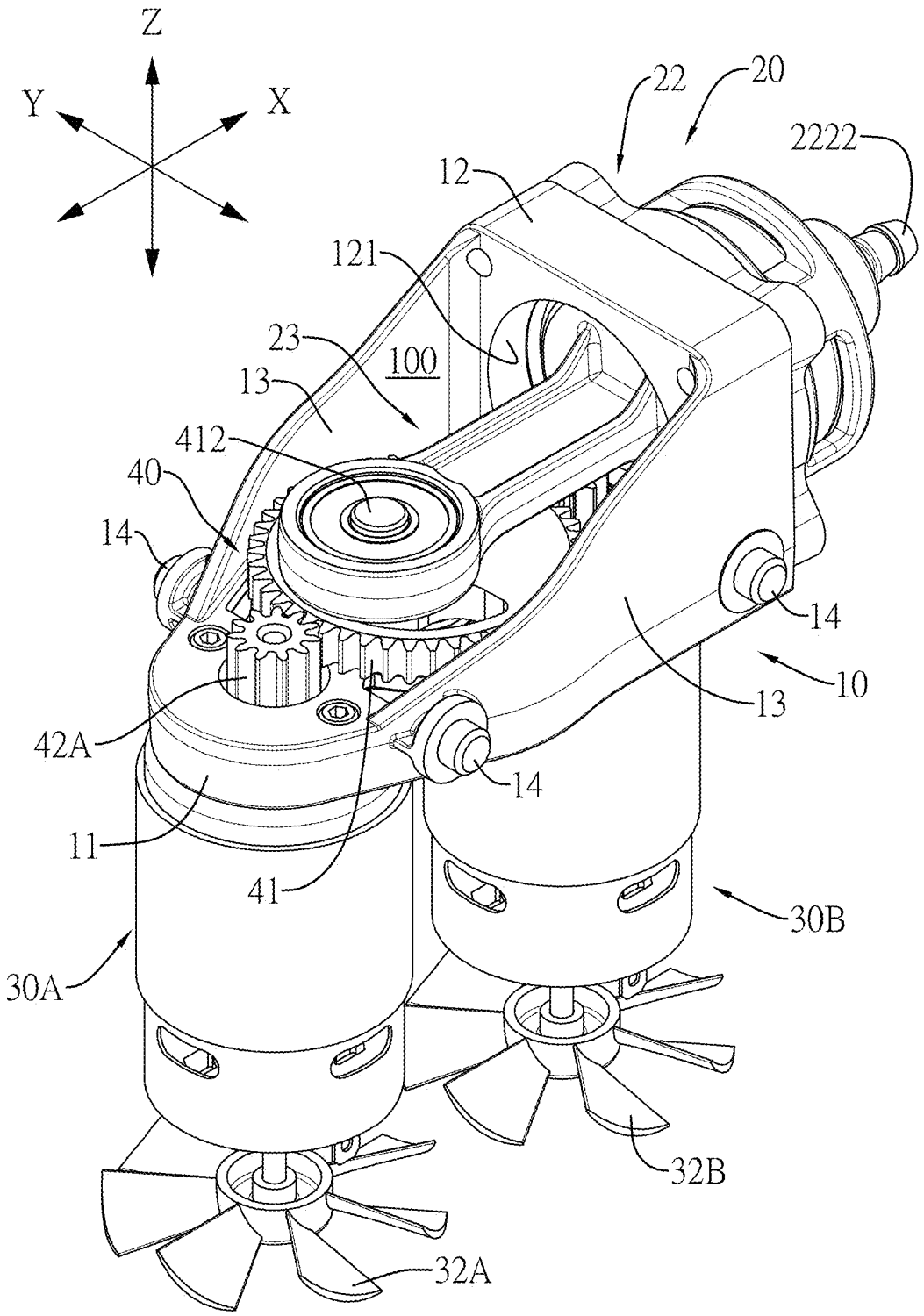
FIG. 1 is a perspective view of a core of a dual-motor-driven inflatable pump in accordance with the present invention.
Figure 2:
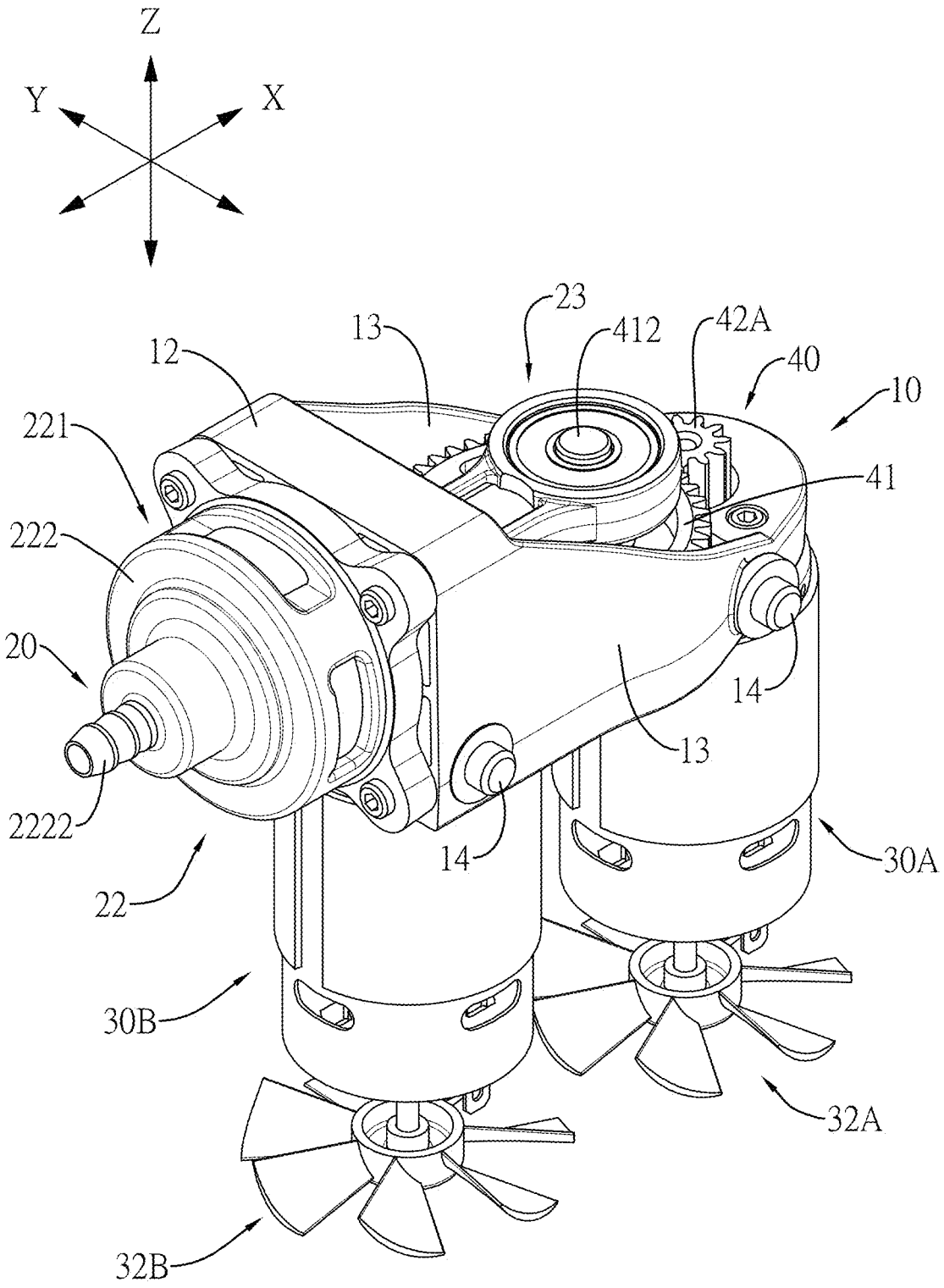
FIG. 2 is another perspective view of the core of a dual-motor-driven inflatable pump in FIG. 1.

With reference to FIGS. 1 and 2, a core of a dual-motor-driven inflatable pump in accordance with the present invention has a base 10, a cylinder 20, two electric motors 30A, 30B, and a drive wheel set 40.

With reference to FIGS. 1 to 5, the base 10 has an X-axis, a Y-axis, a Z-axis, an assembly portion 11, and a fixing portion 12. The X-axis, the Y-axis, and the Z-axis of the base 10 are orthogonal to each other. The fixing portion 12 is connected to the assembly portion 11 along the X-axis of the base 10. A receiving space 100 is formed in the base 10 between the assembly portion 11 and the fixing portion 12.

The assembly portion 11 has a pivot hole 111 and two through holes 112, 113. The pivot hole 111 is formed through the assembly portion 11 along the Z-axis of the base 10 and communicates with the receiving space 100. The two through holes 112, 113 are formed through the assembly portion 11, are respectively disposed on two sides of the pivot hole 111 along the X-axis of the base 10, and communicate with the receiving space 100. The fixing portion 12 has a via hole 121 formed through the fixing portion 12 along the X-axis of the base 10 and communicating with the receiving space 100.

Figure 3:
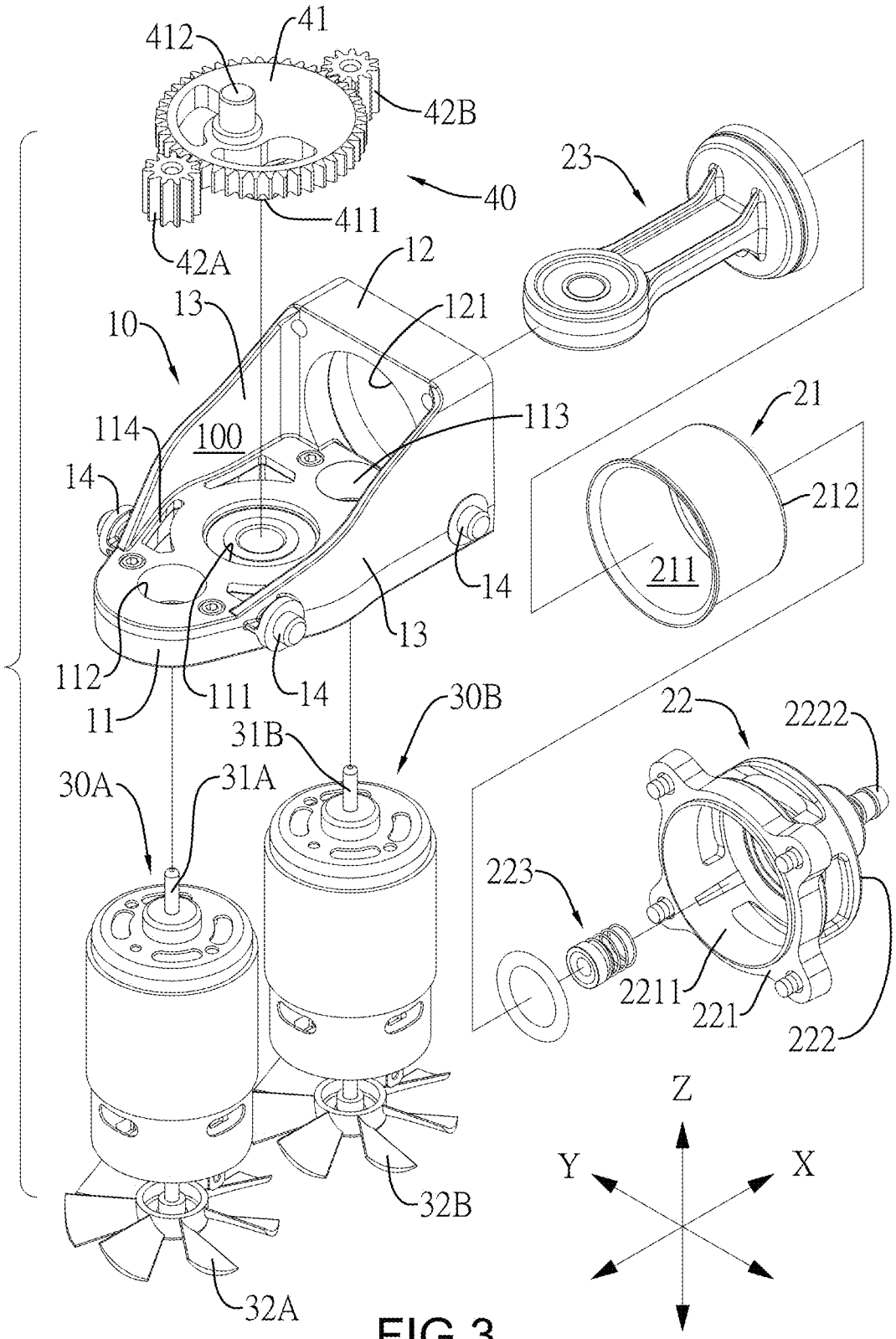
FIG. 3 is an exploded perspective view of the core of a dual-motor-driven inflatable pump in FIG. 1.
Figure 4:
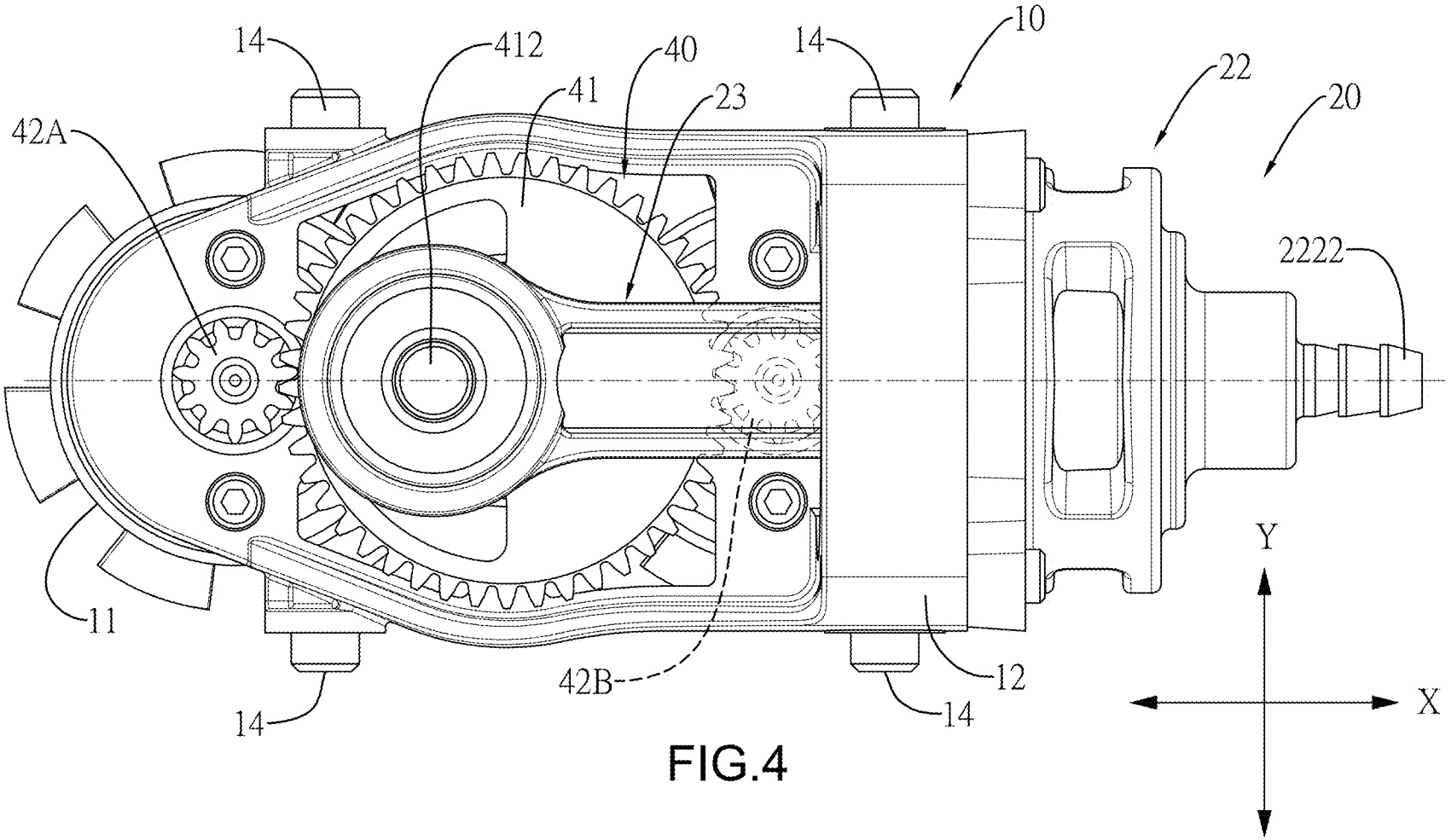
FIG. 4 is a top side view of the core of a dual-motor-driven inflatable pump in FIG. 1.
Figure 5:
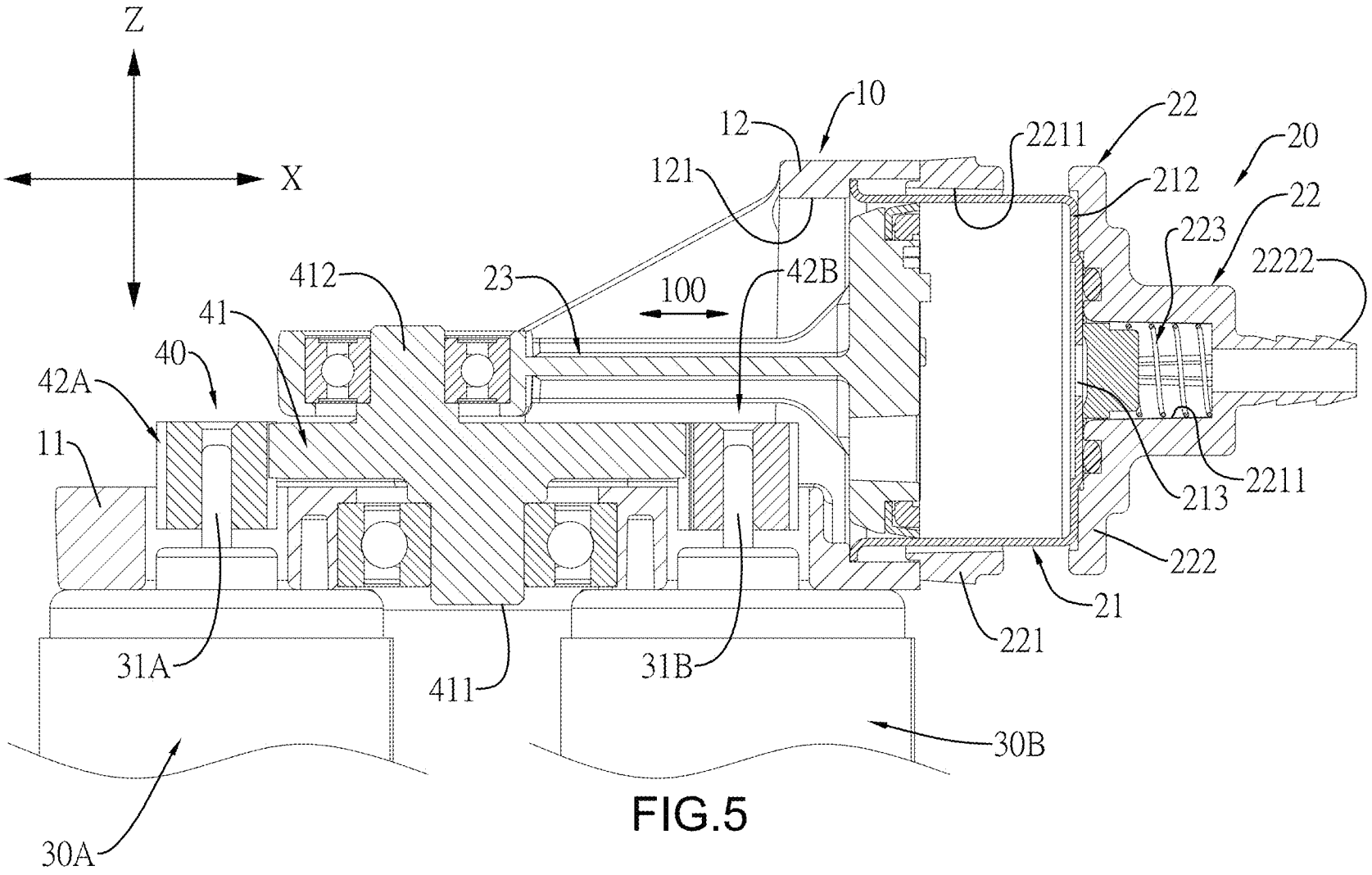
FIG. 5 is an enlarged side view in partial section of the core of a dual-motor-driven inflatable pump in FIG. 1.

With reference to FIGS. 1 to 3, the base 10 has two sidewalls 13 connected to the assembly portion 11 and the fixing portion 12, and located on two opposite sides of the base 10 along the Y-axis of the base 10 to enhance the structural strength of the base 10. Then the base 10 can be made of a plastic material. In addition, the receiving space 100 is formed in the base 10 between the assembly portion 11, the fixing portion 12, and the two sidewalls 13.

Furthermore, the assembly portion 11 has multiple cooling holes 114 formed through the assembling portion 11 to improve the heat dissipation performance of the base 10. The assembly portion 11 has multiple positioning protrusions 14 disposed on two sides of the assembly portion 11 along the Y-axis of the base 10. When the base 10 is assembled in a housing, the positioning protrusions 14 can provide an auxiliary positioning effect to securely install the base 10 in the housing.

With reference to FIGS. 1 to 5, the cylinder 20 is disposed on the base 10 and has a cylinder body 21, a cylinder head 22, and a piston rod 23. The cylinder body 21 is disposed on an outer side of the fixing portion 12 and has a piston chamber 211. The piston chamber 211 is formed in the cylinder body 21 and has an opening formed through one of two sides of the cylinder body 21 along the X-axis of the base 10 and aligning and communicating with the via hole 121. The cylinder body 21 has an end segment 212 formed on the other one of the two sides of the cylinder body 21 opposite to the opening of the piston chamber 211. The end segment 212 has a valve hole 213 formed through the end segment 212.

With reference to FIGS. 1 to 3, and 5, the cylinder head 22 is mounted around the cylinder body 21, is securely connected to the fixing portion 12 of the base 10, and has a cover 221 and an end cap 222. The cover 221 has a mounting space 2211 located around the cylinder body 21. The end cap 222 is formed on an end of the cover 221, abuts against the end segment 212 of the cylinder body 21, and has an outlet channel and an outlet tube 2222. The outlet channel 2221 is formed in the end cap 222 and communicating with the valve hole 213. The outlet tube 2222 is formed on the end cap 222 and communicates with the outlet channel 2221. The cylinder head 22 has a check valve 223 mounted in the outlet channel 2221 to control opening and closing of the valve hole 213. The outlet tube 2222 can be externally connected with an air outlet conduit and is connected to an object to be inflated via the air outlet conduit.

With reference to FIGS. 1 to 3, and 5, the piston rod 23 is mounted in the piston chamber 211 of the cylinder body 21 and extends into the receiving space 100 via the opening of the piston chamber 211 and the via hole 121 of the fixing portion 12. The piston rod 23 is driven to reciprocatingly move in the cylinder chamber 211 along the X-axis of the base 10.

With reference to FIGS. 1 to 5, the two electric motors 30A, 30B are disposed on the assembly portion 11 of the base 10 at a spaced interval along the X-axis of the base 10, and each one of the two electric motors 30A, 30B has a drive shaft 31A, 31B and a fan wheel 32A, 32B. An end of the drive shaft 31A, 31B of each one of the two electric motors 30A, 30B extends into the receiving space 100 via one of the two through holes 112, 113, and the two drive shafts 31A, 31B are arranged in parallel along a direction of movement of the piston rod 23 of the cylinder 20. The fan wheel 32A, 32B of each one of the two electric motors 30A, 30B is disposed on the other end of the drive shaft 31A, 31B of the corresponding electric motor 30A, 30B. When the electric motors 30A, 30B are operated, the fan wheels 32A, 32B are respectively rotated by the electric motors 30A, 30B to provide cooling airflows to the electric motors 30A, 30B.

With reference to FIGS. 1 to 5, the drive wheel set 40 is disposed in the receiving space 100 of the base 10, is connected to the two electric motors 30A, 30B and the piston rod 23, and has a driven gear 41 and two drive gears 42A, 42B. The driven gear 41 is rotatably mounted on the assembly portion 11 of the base 10, aligns with the pivot hole 111, and has a pivot rod 411 and an eccentric shaft 412. The pivot rod 411 is formed on the driven gear 41 and is pivotally mounted in the pivot hole 111. The eccentric shaft 412 is eccentrically formed on the driven gear 41 and is connected to the piston rod 23. The two drive gears 42A, 42B are respectively connected to the drive shafts 31A, 31B of the two electric motors 30A, 30B, engage with the driven gear 41, and have the same number of teeth and modulus. Each one of the two drive gears 42A, 42B has a diameter smaller than a diameter of the driven gear 41. The two electric motors 30A, 30B drive the driven gear 41 via the two drive gears 42A, 42B to move the piston rod 23 reciprocatingly. In the present invention, the two drive gears 42A, 42B respectively connected to the drive shafts 31A, 31B of the two electric motors 30A, 30B are arranged in parallel on two sides of the driven gear 41 along the direction of movement of the piston rod 23 of the cylinder 20 (that is, the X-axis of the base 10).

With reference to FIGS. 1 to 5, in use, the core of the dual-motor-driven inflatable pump in accordance with the present invention is suitable for the inflation of general tires and other inflatable objects, and is more suitable for the inflation of tires of large volume and with high pressure requirements. The core of the dual-motor-driven inflatable pump uses two electric motors 30A, 30B to drive the reciprocating motion of the piston rod 23 of the cylinder 20 via the drive wheel set 40. When the two electric motors 30A, 30B are energized and operated simultaneously, they respectively drive the two drive gears 42A, 42B to rotate in a same direction, and then the two drive gears 42A, 42B drive the driven gear 41 rotating to drive the piston rod 23 to move reciprocatingly in the cylinder body 21, so as to output compressed air in the inflatable objects such as tires.

The two electric motors 30A, 30B of the core of the dual-motor-driven inflatable pump of the present invention can be common electric motors, and the output power generated by the two electric motors 30A, 30B is multiplied to achieve large output power and performance of high inflation speed. At the same time, the cost can be controlled at a low level, so that consumers can inflate large-volume, high-pressure tires and other inflatable objects.

When the piston rod 23 is driven to move forward along the X-axis of the base 10 to compress air, due to the reaction force of the air pressure in the cylinder 21, the reaction force will be transmitted to the eccentric shaft 412 of the driven gear 41 via the piston rod 23, which may cause the driven gear 41 to tilt backwards. In the present invention, the core of the dual-motor-driven inflatable pump further utilizes two electric motors 30A, 30B and the drive gears 42A, 42B arranged along the direction of movement of the piston rod 23 of the cylinder 20 (that is, the X-axis of the base 10) are arranged in parallel on the two sides of the driven gear 41, and the driven gear 41 is jointly driven by the two electric motors 30A, 30B via the two drive gears 42A, 42B to drive the piston rod 23 to move reciprocatingly. Then the force of the driven gear 41 driving the reciprocating movement of the piston rod 23 can be balanced, and it is not easy to be skewed, and the smoothness of the movement of the cylinder 20 can be improved, thereby reducing the load and operating current of the inflatable pump in operation, and prolonging service life of the inflatable pump.

Even though numerous characteristics and advantages of the present invention have been set forth in the foregoing description, together with details of the structure and features of the invention, the disclosure is illustrative only.

Changes may be made in the details, especially in matters of shape, size, and arrangement of parts within the principles of the invention to the full extent indicated by the broad general meaning of the terms in which the appended claims are expressed.

What is claimed is:

1. A core of a dual-motor-driven inflatable pump, the core comprising:

a base having an assembly portion;

a fixing portion connected to a side of the assembly portion; and a receiving space formed in the base between the assembly portion and the fixing portion;

a cylinder disposed on the base and having a cylinder body;

a cylinder head connected to the cylinder body to dispose the cylinder body on the fixing portion and having a check valve; and a piston rod disposed in the cylinder body and extended in the receiving space via the fixing portion;

two electric motors disposed on the assembly portion of the base at a spaced interval, and each one of the two electric motors having a drive shaft extended in the receiving space; and a drive wheel set disposed in the receiving space of the base and having a driven gear mounted in the receiving space of the base; and two drive gears engaging with the driven gear, and each one of the two drive gears having a diameter smaller than a diameter of the driven gear;

wherein the two electric motors drive the two drive gears rotating to drive the piston rod to move reciprocatingly via the driven gear;

the cylinder body is disposed on an outer side of the fixing portion and has a piston chamber formed in the cylinder body and having an opening formed through one of two sides of the cylinder body and facing the receiving space; and an end segment formed on the other one of the two sides of the cylinder body opposite to the opening of the piston chamber and having a valve hole formed through the end segment;

the cylinder head is mounted around the cylinder body, is securely connected to the fixing portion of the base, and has a cover having a mounting space located around the cylinder body; and an end cap formed on an end of the cover, abutted against the end segment of the cylinder body, and having an outlet channel formed in the end cap and communicating with the valve hole; and an outlet tube formed on the end cap and communicating with the outlet channel;

the check valve is mounted in the outlet channel to control opening and closing of the valve hole; and the piston rod is mounted in the piston chamber of the cylinder body and extends into the receiving space via the fixing portion.

2. The core as claimed in claim 1, wherein the driven gear has an eccentric shaft connected to the piston rod;

the two drive gears are respectively connected to the drive shafts of the two electric motors and have the same number of teeth and modulus; and the drive shafts of the two electric motors are arranged in parallel on two sides of the driven gear along a direction of movement of the piston rod of the cylinder.

3. The core as claimed in claim 1, wherein the base has two sidewalls connected to the assembly portion and the fixing portion, and located on two opposite sides of the receiving space of the base.

4. The core as claimed in claim 1, wherein each one of the two electric motors has a fan wheel disposed on an end of the drive shaft of the corresponding electric motor.

5. The core as claimed in claim 2, wherein each one of the two electric motors has a fan wheel disposed on an end of the drive shaft of the corresponding electric motor.

6. The core as claimed in claim 3, wherein each one of the two electric motors has a fan wheel disposed on an end of the drive shaft of the corresponding electric motor.

* * * * *